United States Patent [19]

Dropczynski

[11] Patent Number: 5,067,663

[45] Date of Patent: Nov. 26, 1991

[54] DRUM-TYPE WINDER FOR WINDING WEBS OF MATERIAL

[75] Inventor: Hartmut Dropczynski, Dormagen, Fed. Rep. of Germany

[73] Assignee: Jagenberg Aktiengesellschaft, Dusseldorf, Fed. Rep. of Germany

[21] Appl. No.: 469,621

[22] Filed: Jan. 24, 1990

[30] Foreign Application Priority Data

Feb. 16, 1989 [DE] Fed. Rep. of Germany ..... 3904598

[51] Int. Cl.[5] ..... B65H 19/20

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 4,422,588 | 12/1983 | Nowisch | 242/56 R |
| 4,444,360 | 4/1984 | Kaipf et al. | 242/56 R |
| 4,485,979 | 12/1984 | Dropczynski | 242/56 R |
| 4,485,980 | 12/1984 | Gorner | 242/56 R |
| 4,516,735 | 5/1985 | Snygg | 242/56 R |
| 4,552,316 | 11/1985 | Dropczynski et al. | 242/56 R |
| 4,601,441 | 6/1986 | Oinonen et al. | 242/56 R |
| 4,635,867 | 1/1987 | Kytonen | 242/56 R |
| 4,842,209 | 6/1989 | Sankkonen | 242/56 R |

FOREIGN PATENT DOCUMENTS 3207461 9/1983 Fed. Rep. of Germany .

*Primary Examiner*—Daniel P. Stodola
*Assistant Examiner*—John Q. Nguyen
*Attorney, Agent, or Firm*—Sprung Horn Kramer & Woods

[57] ABSTRACT

A drum-type winder for winding web of material, especially webs of paper or board, on cores, with a pressure-application roller that can be raised and lowered positioned above the drums and with a mechanism for separating the web and fastening the newly created initial web section to a new core. Components on each side of the frame travel up and down with both the pressure-application roller and the separating and fastening mechanism secured to them such that they can be shifted alternately into the area between the drums.

6 Claims, 2 Drawing Sheets

DRUM-TYPE WINDER FOR WINDING WEBS OF MATERIAL

The invention relates to a drum-type winder for winding webs of material, especially webs of paper or board, on cores.

Known drum-type winders have a pressure-application roller that extends over the operating width of the winder and travels up and down above the bed between the two drums on upright lateral tracks, pressing against the reel as the winding process begins. The additional pressure against the drum helps ensure that the reel will be as hard as desired when it is not heavy enough to do so on its own.

Also known are drum-type winders with a mechanism for separating the web and fastening the new initial web section to a fresh core once the full reel has been ejected. The mechanism that separates the web and fastens the new initial web section in the generic winder known from U.S. Pat. No. 4,485,979 is accommodated in the ejector beam, which has an opening through which the mechanism projects on the side facing the winding bed. The same winder has a pressure-application roller that travels up and down.

To handle cores that vary widely (90–500 mm) in diameter, the separating and fastening mechanism that can be pivoted into the bed along with the ejector beam can also be shifted across the axis of the drums to fasten the new initial web section to advantage in the vicinity of the apical line of the core.

One drawback of the reel-changing mechanism known from U.S. Pat. No. 4,485,979 is that, due to the requisite opening in the ejector beam, only reels of at least a certain diameter can be ejected. Since a complete set of reels is in practice selected for rejection just after winding commences and must be removed from the bed, the reels must be removed manually. It is alternatively possible to employ additional locking mechanisms to cover the opening in the ejector beam. Furthermore, an ejector beam that also travels across the axis of the drum occupies relatively a lot of space.

The object of the present invention is to provide a generic drum-type winder capable of handling cores that vary widely in diameter and has an ejector beam that can remove reels with even a short diameter from the drum bed.

This object is realized in accordance with the present invention pursuant to which there is provided a drum-type winder for winding webs of material, especially webs of paper or board, on cores, comprising a pressure-application roller that can be raised and lowered positioned above the drums, and a mechanism for separating the web and fastening the newly created initial web section to a new core. On each side of a frame there are provided components which travel up and down and to which both the pressure-application roller and the separating and fastening mechanism are secured such that they can be shifted alternately into the area between the drums.

Due to its being installed in conjunction with the pressure-application roller, the separating and fastening mechanism moves into the vicinity of the apical line not from the side but from above, no matter how long the diameter of the core. Since the ejector beam does not have an opening, it can easily be designed to eject reels with a very short diameter (<200 mm).

Another advantage is that, since the ejector beam occupies less space, the free section of web between the upstream slitter and the looped drum can be shortened to advantage. The drums are also more accessible for maintenance.

Advantageously both the pressure-application roller and the separating and fastening mechanism are mounted on a pivoting arm. The advantage of this measure is that they travel a minimum path into the operating position. The embodiment recited in claim 5 ensures that both the pressure-application roller and the separating and fastening mechanism will come to rest in the vicinity of the apical line of the core or reel.

The drawings illustrate the invention by way of one embodiment that is represented simplified.

Figure 1:
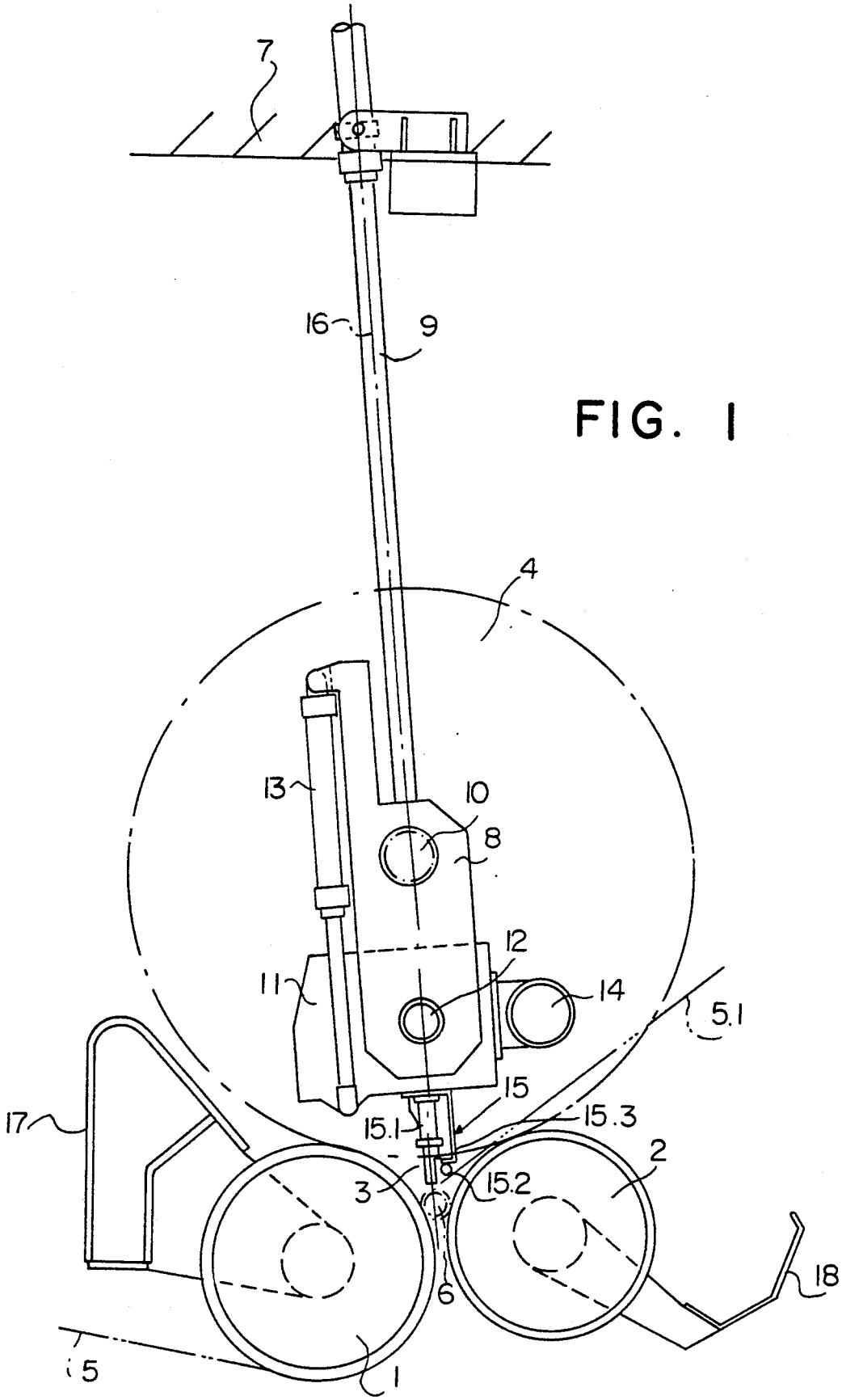
FIG. 1 is a side view of a drum-type winder in accordance with the invention with its separating and fastening mechanism in the operating position.

The illustrated drum-type winder has two driven drums 1 and 2 with a drum bed 3 left between them to accommodate reels 4 while they are being wound on the drums. A web 5, preferably a web of paper or board, that has been slit into subsidiary webs is deflected by drum 1 and advances up between drums 1 and 2 to be wound onto aligned cores 6. Drum-type winders of this type are known and are described in German OS 3 207 461 for example, from which any engineering details not specified herein can be derived.

Figure 2:
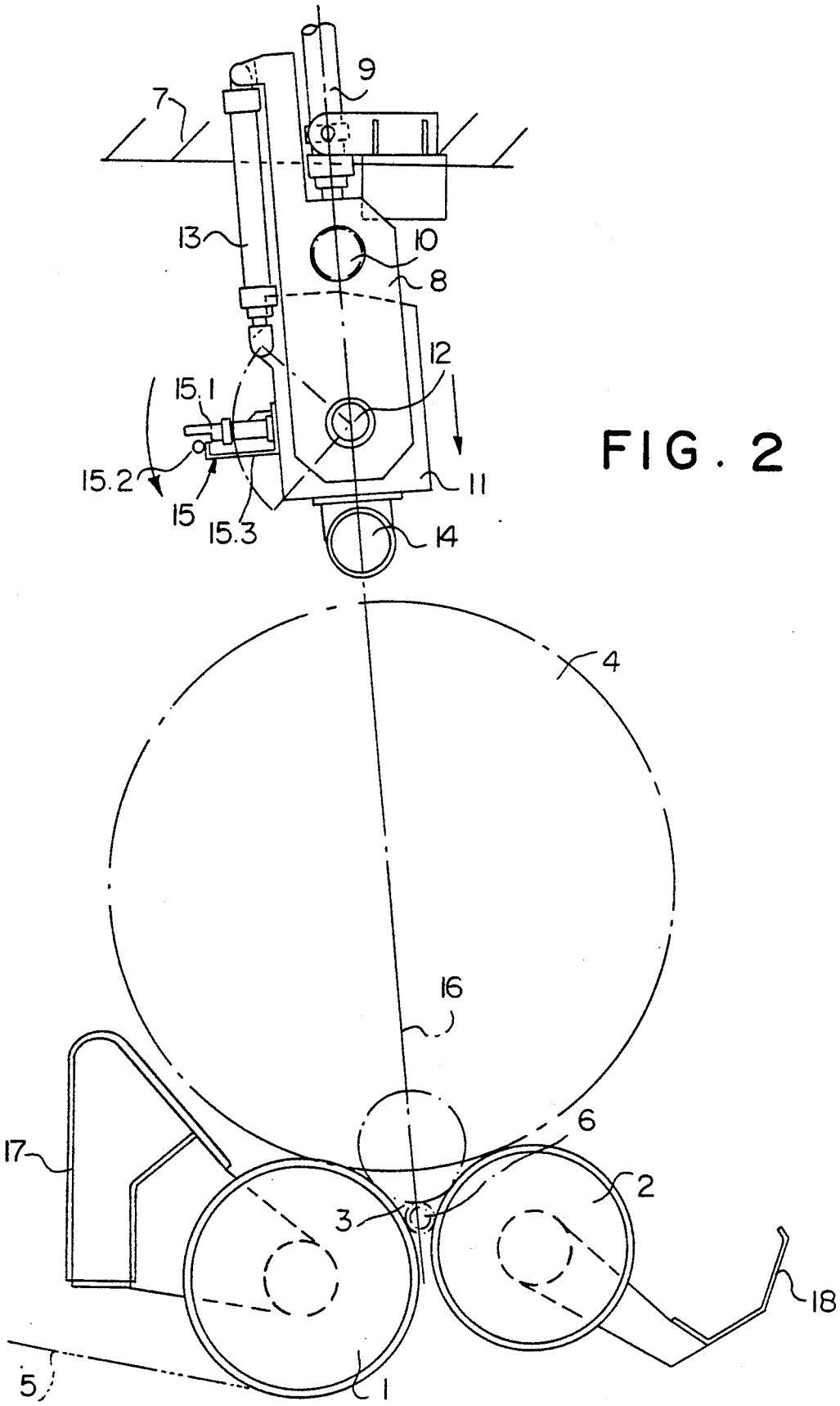
FIG. 2 is a side view with the pressure-application roller in the operating position.

The winder's frame 7 is indicated only schematically in FIGS. 1 and 2. It accommodates a shield-shaped cheek 8 that travels more or less vertically in unillustrated tracks along each side of the machine and at each side of the web. Its vertical motion is governed by a piston-and-cylinder unit 9 secured to frame 7 above the bed and outside the vicinity of a full reel 4 with its piston flanged to the top of cheek 8. Cheeks 8 are raised and lowered together by a synchronized shaft 10 that extends over the width of the winder with its ends rotating in cheeks 8 and having pinions that engage racks positioned along the tracks.

An arm 11 that pivots 90° around an axis 12 in the bottom of cheeks 8 extends over the operating width between the cheeks. The pivoting motion is governed by a piston-and-cylinder unit 13 secured both to cheek 8 and to arm 11. Freely rotating on one side of arm 11 is a pressure-application roller 14 that extends over the operating width. Mounted on the adjacent and vertically bent-down side is a mechanism 15 that separates the web from the full reel and fastens the new initial section of the web to the fresh core. Separating and fastening mechanism 15 consists of a fastening component 15.1 and of a knife 15.2 that travel together over the total operating width along a track 15.3 secured to arm 11. Pressure-application roller 14 and separating and fastening mechanism 15 are secured to arm 11 such that piston-and-cylinder unit 13 can pivot them alternately precisely into a perpendicular 16, which extends through the middle of drum bed 3, to the joint upper tangent to drums 1 and 2. This characteristic is attained in a practical way in that the pivoting axis 12 is positioned on middle perpendicular 16 and in that the lines connecting axis 12 to the center of pressure-application roller 14 and to the fastening line established by fastening component 15.1 coincide with perpendicular 16 when the system is in the downward-pivoted position.

The reels are replaced by ejecting the full reels 4 out of drum bed 3 and over drum 2 with an ejector beam 17 and inserting a set of fresh cores 6 below web 5.1 and into drum bed 3 with a channel 18 that swings over drum 2 and into the bed. Ejector beams of this type are known and are described in U.S. Pat. No. 4,485,979. Since the ejector beam 17 in accordance with the invention has no opening for separating and fastening mechanism 15, its ejecting surface extends intact into the vicinity of drum 1. Once the full reel 4 has been ejected, arm 11 is lowered until the downward-pivoted fastening component 15.1 arrives at the apical line of the inserted fresh cores 6 (FIG. 1). Mounted on the lateral core tensioners are stops that ensure that fastening component 15.1 will be at the correct distance from the surface of the core no matter what its diameter. Fastening component 15.1 and knife 15.2 now travel along the width of web 5, separating outgoing web 5.1 and simultaneously fasten the new initial web section to cores 6. Instead of fastening component 15.1, a traveling mechanism for fastening the initial web section to cores 6 with a strip of adhesive tape can be employed. Arm 11 is then pivoted 90° clockwise to precisely position pressure-application roller 14 above the apical line of cores 6. Drums 1 and 2 are then activated, winding web 5 on cores 6. Until the increasing weight of reels 4 is sufficient to ensure the desired hardness, pressure-application roller 14 will rest against the reels and press down with a prescribed force to increase the nip forces between the drums. Once reels 4 are finished, arm 11 raises pressure-application roller 14 into an upper and disengaged position (FIG. 2), simultaneously ejecting the reels. Arm 11 then pivots 90° counterclockwise and lowers, separating the outgoing section 5.1 of the web and fastening the new initial web section to a set of freshly inserted cores 6.

It will be understood that the specification and examples are illustrative but not limitative of the present invention and that other embodiments within the spirit and scope of the invention will suggest themselves to those skilled in the art.

What is claimed is:

1. A drum-type winder comprising:

a stationary frame;

a pair of winding drums defining a space therebetween for accommodating a core onto which a web of material is wound into a roll;

a pair of vertically movable cheeks carried by the frame and positioned above said space, the pair of cheeks being spaced apart on opposite sides of the web and being rotatably connected together by a shaft;

a piston and cylinder unit connected to the pair of cheeks for raising and lowering the cheeks into and out of said space;

an arm having at least two sides pivotably connected between the pair of cheeks;

a pressure-application roller secured to one side of the arm;

a mechanism for separating the web from a wound roll and fastening the newly-created initial web section to a new core, the separating and fastening mechanism being secured to another side of the arm; and means for alternately pivoting the pressure-application roller and the separating and fastening mechanism about a pivot axis parallel to the shaft whereby the pressure-application roller and the separating and fastening mechanism are alternatively introduced into said space by actuation of the pivoting means.

2. A winder according to claim 1, wherein the pressure-application roller and the separating and fastening mechanism are secured to the two sides of the arm which meet in approximately a right angle.

3. A winder according to claim 1, wherein the pivoting means for alternatively introducing the pressure-application roller and the separating and fastening mechanism into the space between the drums includes an articulated piston-and-cylinder unit.

4. A winder according to claim 1, wherein the cheeks travel along a perpendicular midline of the upper joint tangent to the drums, the axis around which the arm pivots also falling on the perpendicular midline.

5. A winder according to claim 1, including a track along which the separating and fastening mechanism travels, the track extending over the operating width between the cheeks.

6. A winder according to claim 1, including a mechanism which pivots around the upstream-end drum and ejects full rolls and another mechanism that pivots around the downstream-end drum and inserts fresh cores.

* * * * *